United States Patent [19]

Ace

[11] 4,195,437

[45] Apr. 1, 1980

[54] CONVERTIBLE DOLL HOUSE

[75] Inventor: Marshall Ace, New York, N.Y.

[73] Assignee: Ideal Toy Corporation, Hollis, N.Y.

[21] Appl. No.: 883,069

[22] Filed: Mar. 3, 1978

[51] Int. Cl.[2] ..... A63H 33/16; A63H 33/06

[52] U.S. Cl. ..... 46/21; 46/31; 35/16

[58] Field of Search ..... 46/19, 12, 16, 30, 21, 46/13, 31; 52/68, 66, 64; 108/11, 12, 17; 211/149; 35/16

[56] References Cited

U.S. PATENT DOCUMENTS

| | | | |
|---|---|---|---|
| 881,278 | 3/1908 | Acheson | 108/12 |
| 3,044,211 | 7/1962 | Palm | 46/12 X |
| 3,070,399 | 12/1962 | Bartlett | 52/68 X |
| 3,629,969 | 12/1971 | Dodd | 46/21 |

FOREIGN PATENT DOCUMENTS

| | | | |
|---|---|---|---|
| 377258 | 4/1964 | Switzerland | 46/31 |

*Primary Examiner*—Louis G. Mancene
*Assistant Examiner*—Mickey Yu
*Attorney, Agent, or Firm*—Richard M. Rabkin

[57] ABSTRACT

A convertible doll house is provided which includes first and second house sections each of which has perpendicularly extending wall and floor panels. The house sections are positioned, in a first relative position, with their wall panels pivotally connected adjacent to each other and with their floor panels lying in substantially the same plane, thereby to form a one-story doll house. One of the house sections includes a stilt for supporting it in a second pivoted position with respect to the other house section so that its wall panel extends perpendicularly to the wall panel of the other section, in spaced vertical relation to the floor panel of the other section, thereby to form a two-story doll house.

11 Claims, 18 Drawing Figures

FIG. 6
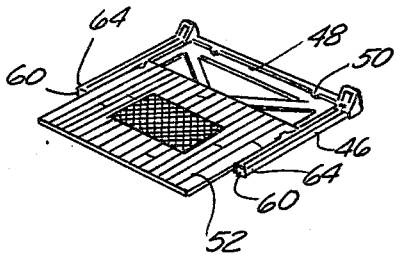
FIG. 7
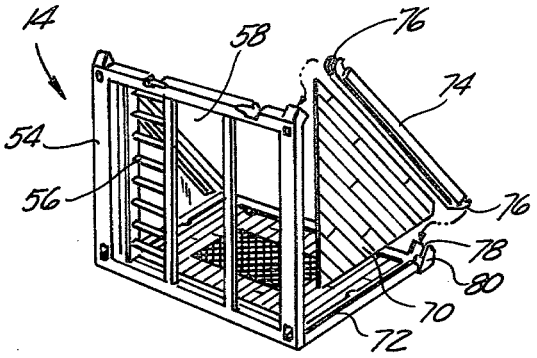
FIG. 7a
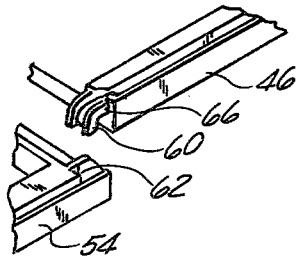
FIG. 7b
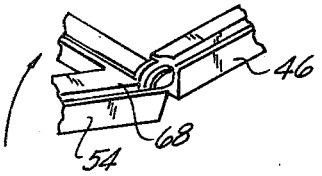
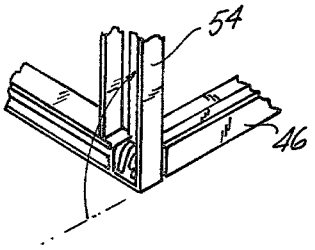
FIG. 7c

CONVERTIBLE DOLL HOUSE

The present invention relates to doll houses, and in particular to a doll house which is convertible from a one- to a two-story structure.

Conventional doll houses have a fixed structure, i.e. as either a one- or two-story building. The present invention however provides a doll house which is readily convertible from a one- to a two-story structure, to increase the play value of the doll house and permit the child to increase his or her play variations with the doll house.

Accordingly, it is an object of the present invention to provide a doll house which, while converting from a one-story to a two-story dwelling, will also substantially automatically permit a change in the appearance of the rooms of the doll house.

Another object of the present invention is to provide a convertible doll house in which the apparent setting for the house is automatically changed when the house is converted between its one- and two-story configuration.

A still further object of the present invention is to provide a doll house which is relatively simple in structure and easily converted from its one- to two-story configuration by even a small child.

A still further object of the present invention is to provide a convertible doll house which is inexpensive to manufacture and yet durable in use.

In accordance with an aspect of the present invention, the convertible doll house includes first and second house sections, each of which has a wall panel including upper and lower edges and a floor panel connected to the wall panel and extending generally perpendicularly from the wall panel's lower edge. The wall panels are pivotally interconnected adjacent their upper edges so that the house sections are positionable in a first position with the wall panels in adjacent and parallel relation to each other, with their floor panels lying substantially in the same plane to provide a single floor one story playhouse. The first house section includes support means which is adapted to support the first house section in a second position with respect to the second house section wherein the wall panel of the first house section extends perpendicularly from the upper edge of the wall panel of the second house section, parallel to the floor of the second house section, so that the wall panel of the first house section serves in the second position as a floor panel, thereby to form a two-story playhouse. The first house section is also provided with a movable insert panel, which selectively covers the floor and wall panels of the first house section depending upon the relative position of the house sections, to convert the wall panel of the first house section to a simulated floor panel, depending upon its relative position with respect to the second house section.

The above, and other objects, features and advantages of this invention will be apparent in the following detailed description of an illustrative embodiment thereof, which is to be read in connection with the accompanying drawings, wherein.

Figure 4:
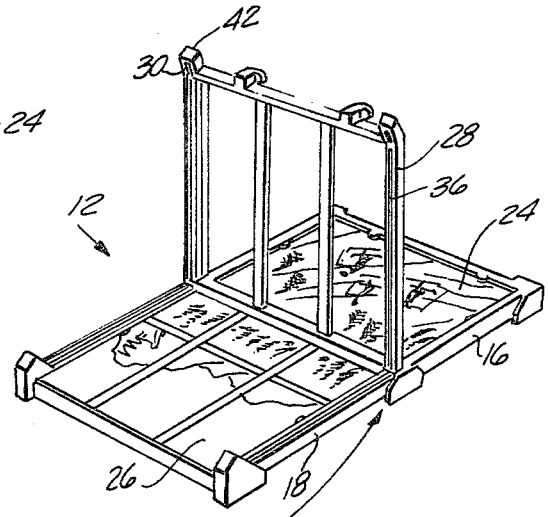
FIG. 4 is a perspective view illustrating the mounting of the wall panel of the first house section on the floor panel.
Figure 4A:
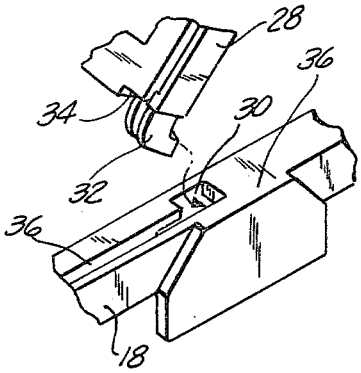
Figure 5:
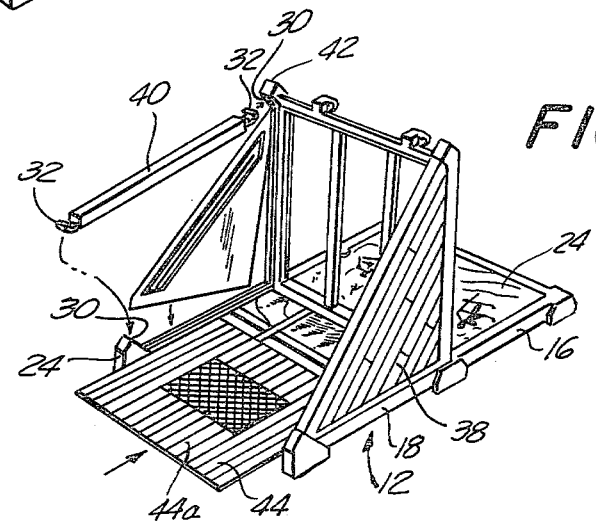
Figure 8:
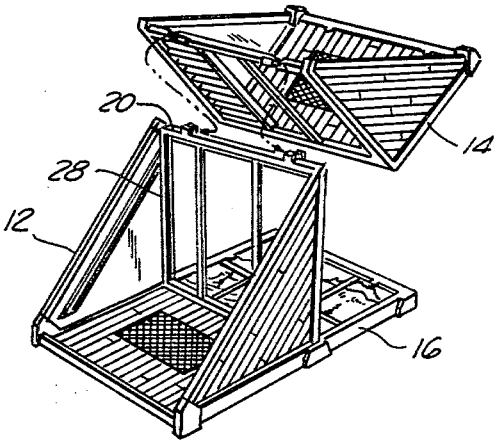
Figure 8A:
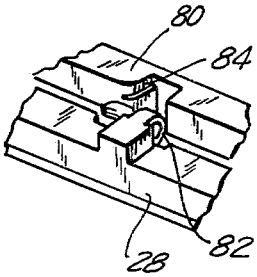
Figure 9A:
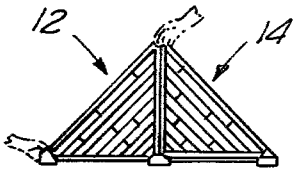
Figure 9B:
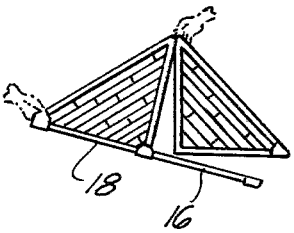
Figure 9C:
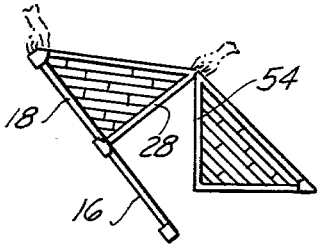
Figure 9D:
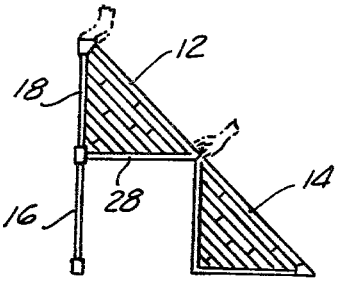
Figure 9E:
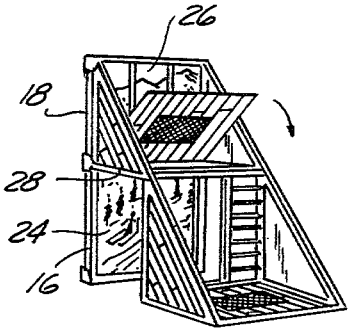

FIG. 4*a* is an exploded perspective view showing, in detail, the connection between the wall panel and floor panel of the first house section;

FIG. 5 is a perspective view illustrating the assembly of the side walls of the first house section to the floor and wall panels thereof;

FIG. 6 is a perspective view of the floor panel of the second house section;

FIG. 7 is a perspective view showing the assembly of the wall panel and side walls of the second house section to the floor panel;

FIGS. 7*a*–7*c* are partial enlarged perspective views showing the releasable connection between the wall panel and floor panels of the second house section;

FIG. 8 is a perspective view showing the manner in which the second house section is pivotally connected to the first house section;

FIG. 8*a* is an enlarged perspective view of the pivotal connection between the house sections shown in FIG. 8; and FIGS. 9*a*–9*e* illustrate the movement of the first house section with respect to the second house section to convert the doll house from its one-story to its two-story configuration.

Figure 1:
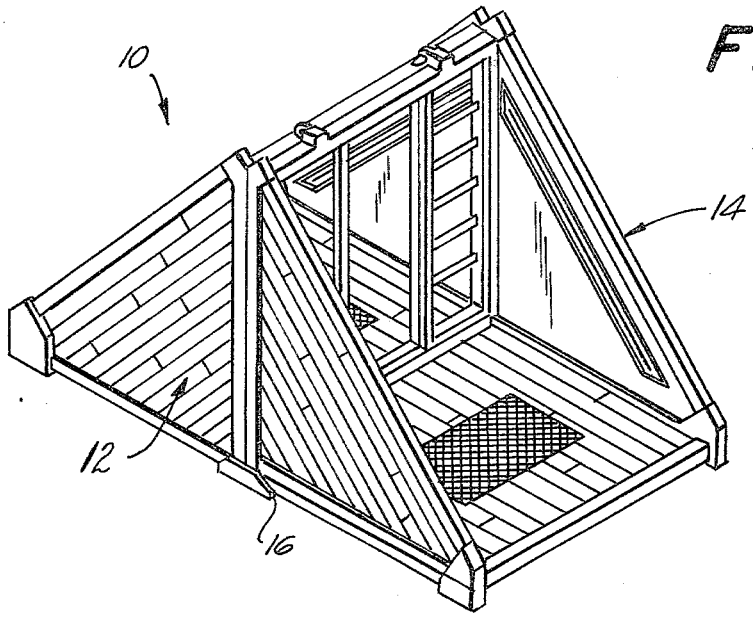
FIG. 1 is a perspective view of the convertible doll house of the present invention in its one-story configuration.

Referring now to the drawing in detail, and initially to FIG. 1 thereof, a convertible doll house 10, constructed in accordance with the present invention, includes first and second doll house sections 12, 14 which, in the first relative position thereof are arranged to provide an A-frame type dwelling, having a single floor. The house sections are pivotally connected to each other so that they can be re-positioned from the position shown in FIG. 1 to the position shown in FIG. 2, wherein a two-story house is provided.

Figure 2:
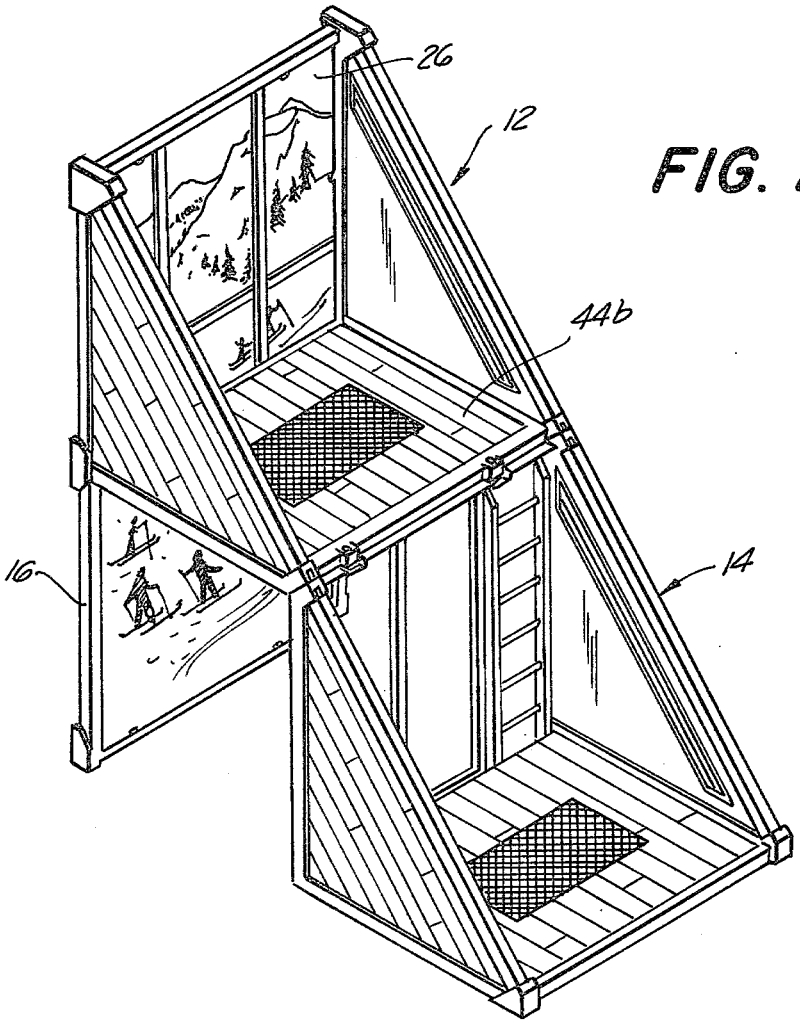
FIG. 2 is a perspective view of the toy house shown in FIG. 1, in its two-story configuration.

House sections 12, 14, are generally equilateral right triangularly shaped structures, whose legs form wall and floor panels, and whose hypotenuse side is open. However, house section 12 includes an extension portion 16 which serves as a stilt to support house section 12 in its second position as shown in FIG. 2.

Figure 3:
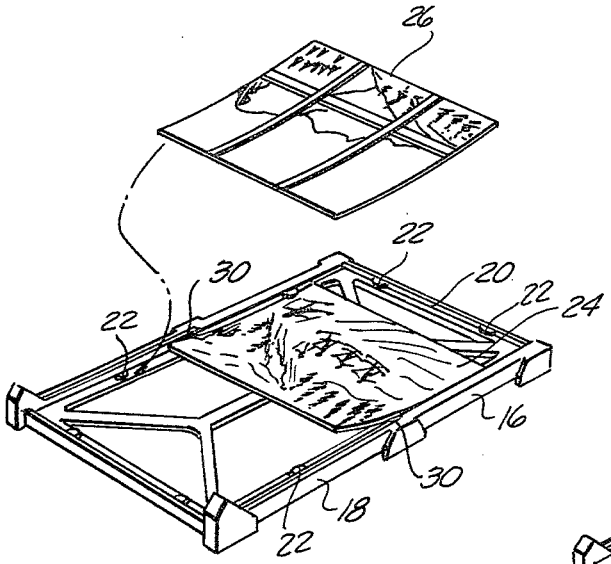
FIG. 3 is a perspective view of the floor panel of the first house section, showing the manner in which wall illustrations are mounted therein.

The assembly of the first house section 12 is illustrated in FIGS. 3–5 of the drawing. As seen therein, first house section 12 includes a one-piece floor panel member 18 formed of molded plastic which includes, as an integral portion thereof, extension portion 16. Floor panel 18, and extension 16, form a generally rectangularly shaped member having a recess or well 20 between its sides. A plurality of individual tabs 22 extend from the side walls of well 20 and are adapted to retain illustration panels 24 and 26 on extension 16 and panel 18 respectively. The illustrations can take any desired form, but in the illustrative embodiment a ski scene, seen through a simulated picture window, is provided. As seen in FIG. 1, and as described hereinafter, this scene is hidden from view in the first (one-story) configuration of the doll house, but is exposed to view in the second (two-story) configuration as shown in FIG. 2.

First house section 12 includes a wall panel 28 which is removably connected to floor panel 18 so that the doll house can be assembled or disassembled as desired. This connection can take any convenient form, however as illustrated in the presently preferred embodiment of the invention, floor panel 18 includes a pair of recesses or openings 30 formed in the long sides thereof, while wall panel 38 includes hook shaped elements 32 on the ends of its vertical legs which are adapted to be received in openings 30. Hooks 32 are placed in openings 30 in an angular position, as illustrated in FIG. 4*a*, and then the wall panel is pivoted to its vertical position, wherein the shoulders 34 on the wall panel, surrounding hooks 32, rest on the surface 36 of the side wall of floor panel 18, so that the wall panel is held in its vertical position.

The long legs of floor panel 18, as well as the two vertical legs of the wall panel 28, are provided with elongated recesses 36 formed therein. These recesses are provided to receive the edges of generally triangularly shaped side wall panels 38. The latter may be formed of paperboard or the like and have on opposite sides thereof wall decoration and simulated exterior siding printed thereon. These side wall panels are held in place by removable leg members 40, having hooks 32 formed on their opposite ends which are received in recesses 30 formed in abutments 42 on the ends of the floor panel 18 and wall panel 28, as illustrated in FIG. 5. As previously mentioned, however, the assembly of these elements can be provided in any desired and convenient manner. In any event, the resulting structure is a generally equilateral right triangular house section having an extenion 16 extending therefrom.

First house section 12 includes a simulated floor panel 44 positioned therein. This floor panel has opposite sides 44*a* and 44*b* (not seen in FIG. 5), each of which has imprinted thereon a simulated floor. The insert 44 is simply placed on top of the insert 26 in the floor panel 18, above tabs 22 so that it rests on top of the tabs and is movable with respect to the floor panel, as described hereinafter.

Second house section 14, is similar to first house section 12, except that it does not include extension portion 16. The assembly of the second house section is illustrated in FIGS. 6–7. As seen therein second house section 14 includes a generally rectangular molded plastic floor panel 46, which is substantially complementary to the configuration of the extension portion 16 of first house section 12. This floor panel also has a well 48 formed therein with tabs 50 extending from the side walls thereof. These tabs retain a paperboard floor insert 52, having a simulated floor imprinted thereon.

A wall panel 54 is also provided for the house section 14. This wall panel is generally complementary to the wall panel 28 of first house section 12, except that it is slightly shorter than wall panel 28 and includes a simulated ladder 56 formed therein. In addition, this wall panel, as well as the wall panel 28, is provided with openings 58, so that access is provided between the wall panels for the child's use during play.

Wall panel 54 is connected to floor panel 46 in a manner similar to the connection between the wall and floor panel of the first house section. Floor panel 46 includes a pair of hook shaped elements 60 on the ends of its side edges, while wall panel 54 includes a pair of openings 62 at its lower edge which are adapted to receive hooks 60. Upon insertion of hooks 60 in openings 62, wall panel 54 is pivoted upwardly, as shown in FIG. 7*b*, to its vertical position, wherein the shoulder portions 66 of the floor panel, about the hooks 60, engage the face 68 of the lower end of the wall panel 54, so that the wall panel is held in its vertical position. The wall and floor panels are locked in this position, and the simulated side walls 70, are also held in place (in grooves 72 in the floor and wall panels), by hypotenuse leg portions 74. These legs are similar to the legs 40 previously described and have hooks 76 formed on their ends which are received in openings 78 in abutments 80 formed on the floor and wall panels of the second house section, respectively.

Second house section 14 is pivotally connected to first house section 12 along the upper edges 80 of the respective wall panels 28, 54, with the second house section 14 overlying the extension portion 16 of the first house section. The pivotal connection between the house sections is formed in any convenient manner, so as to be releasable, to permit disassembly of the toy house when desired. In the illustrative embodiment of the invention, as seen in FIGS. 8 and 8*a*, the upper end of wall panel 28 of first house section 12 simply includes a pair of recessed bearings 82 formed therein while the upper end portion 80 of wall panel 54 has a pair of studs 84 formed therein. The studs and recesses face in opposite directions, as seen in FIG. 8, and by slightly bending the top edge 80 of wall panel 54, the studs can be easily inserted in bearings 82. In this connection, it is noted that while all of the wall, floor panels and structural elements of the doll house in the present invention are formed from a relatively rigid molded plastic material, the material has some flexibility which permits the slight flexing of the top edge 80 of wall panel 54, so that the pivot studs or pins can be inserted in this manner.

With the second house section pivotally connected to the first house section, the doll house is in the configuration shown in FIG. 1. As seen therein, the pictorial scene placed on the floor panel of the first house section is completely hidden from view by the movable second floor insert 46 in the first house section and by the second house section, which overlies extension 16. In this regard, it is again noted that the wall panel of second house section 14 is slightly shorter than the wall panel of first house section 12 so that extension 16 can fit therebelow.

When it is desired to convert the doll house from the one-story A frame configuration in FIG. 1 to the two-story configuration in FIG. 2, first house section 12 is pivoted with respect to second house section 14, through the sequence shown in FIGS. 9*a*–9*e*. Preferably, second house section 14 is held in one hand and first house section 12 is held in the other, while the first house section is pivoted about pivots 82 until floor panel 18 is parallel to wall panel 54 of the second house section and the wall panel 28 is perpendicular to the wall panel 54. In that position extension 16 serves as a stilt to support first house section 12 in this second position with respect to house section 14. Also, in this second position the pictorial insert 24, which is mounted in extension 16, is exposed to view through the openings 58 in panel 54 of second house section 14. To expose the pictorial insert 26 in floor panel 18, floor insert 44 is simply flipped downwardly, seen in FIG. 9*e*, to expose its opposite side 44*b*. This converts wall panel 28 of first house section 12 to a simulated floor, as seen in FIG. 2, while exposing pictorial insert 26. In this manner, the roles of the floor and wall panels of the first house section are reversed, essentially automatically, so that the doll house is converted into a two-story dwelling whose rear wall is a simulated two-story picture window.

Accordingly, it is seen that a relatively simply constructed doll house arrangement is provided which is easily converted from a one- to two-story doll house by a simple pivotal movement. This structure is durable in construction and economical to manufacture, and yet provides an increased play value for a child playing with the doll house.

Although an illustrative embodiment of the invention has been described herein with reference to the accompanying drawing, it is to be understood that the invention is not limited to that precise embodiment, and that various changes and modifications may be effected therein by one skilled in the art without departing from the scope of this invention.

What is claimed is:

1. A convertible doll house comprising first and second house sections having perpendicularly extending wall and floor panels, said sections being positioned in a first position with said wall panels adjacent and pivotally connected to each other and with said floor panels lying in substantially the same plane; and means for supporting one of said sections in a second position with respect to the other of the house sections with the wall panel of said one section extending perpendicularly to the wall panel of the other section; and means on said floor panel of said first house section for simulating a floor and for concealing a simulated wall scene on said floor panel, said simulating means being movable to cover said wall panel of said one house section in said second position to expose said wall scene and convert said wall panel to a simulated floor panel.

2. A convertible doll house comprising first and second house sections each having a wall panel including upper and lower edges and a floor panel connected to extend generally perpendicularly from the lower edge of its associated wall panel; said wall panels being pivotally interconnected adjacent their upper edges whereby said house sections are positionable in a first position with said wall panels located adjacent and parallel to each other and said floor panels lying in substantially the same plane to provide a single floor playhouse; and means for supporting said first house section in a second position with respect to said second house section wherein the wall panel of the first house section extends perpendicularly from the upper edge of the wall panel of the second house section and parallel to the floor panel of the second house section, whereby said wall panel of the first house section serves in said second position, as a floor panel thereby to form a two story playhouse in said second position of said house sections.

3. A convertible doll house as defined in claim 2 including an insert panel placed in said first house section on said floor panel thereof in said first position of the house sections, and being generally complementary to said floor panel; said insert having simulated floor covering printed on both sides thereof whereby when said first house section is pivoted from said first to said second position said insert can be pivoted to expose said floor panel and cover the wall panel thereby transforming the wall panel of the first house section to a floor in the second positions of said house sections.

4. A convertible doll house as defined in claim 4 wherein said means comprises an extension of the floor panel of said first house section having a length substantially equal to the length of the wall panel of the second house section whereby said extension is adapted to operate as a stilt in said second position of said house sections.

5. A convertible doll house as defined in claim 4 wherein the wall panel of said second house section is slightly shorter than the wall panel of the first house section whereby said extension is adapted to be positioned below the floor panel of said second house section in the first position of the house sections where it is substantially hidden from view.

6. A convertible doll house as defined in claim 5 including first insert means mounted in said floor panel and said extension of said first house section having indicia thereon representative of a wall exposed to view in the second position of said house sections.

7. A convertible doll house as defined in claim 6 including a second insert generally complementary to said floor panel of the first house section and having a simulated floor printed on both sides thereof, positioned on said floor panel over said first insert means in the first position of said house section with one of the sides exposed whereby said first insert means is entirely hidden from view in said first position by said second insert and said second house section in said first position; said second insert being movable to cover said wall panel of the first house section in said second position while exposing its other side thereby to convert said wall panel to simulated floor panel while exposing said first insert means in the floor panel of the first house section.

8. A convertible doll house as defined in claim 7 wherein said second house section has an opening therein whereby said first insert means in said extension of the first house section is visible through said second house section in said second position.

9. A convertible doll house as defined in claim 8 wherein said first and second house sections are formed as generally congruent equilateral right triangles with the legs thereof respectively forming said floor and wall panels.

10. A convertible doll house comprising a pair of generally triangular frame sections each having first and second bases and a hypotenuse extending therebetween positioned in a first position thereof with their first bases in adjacent parallel relation to each other and their second bases lying in substantially the same plane, said seconds being pivotally connected together adjacent the intersection of said first bases with their hypotenuses; and means on one of said sections for supporting said one section in a second position with respect to the other section with the hypotenuses of the sections in longitudinal alignment and the first legs thereof extending generally perpendicular to each other adjacent said pivotal connection therebetween; said means comprising an extension of the second base of said one house section having a length substantially equal to the height of the first base of the other house section whereby the extension is adapted to operate as a stilt in the second position of the house.

11. A convertible doll house as defined in claim 10 wherein said house sections are formed as generally congruent equilateral right triangles.

* * * * *